US007411140B1

(12) United States Patent
Davison et al.

(10) Patent No.: US 7,411,140 B1
(45) Date of Patent: Aug. 12, 2008

(54) INERTIAL MASS DETECTION DEVICE

(76) Inventors: Muriel G Davison, 1220 Quail Run La., Cumming, GA (US) 30041; Thomas Delor, 1380 Gulf Blvd., Sand Key Club #908, Clearwater, FL (US) 33767; Francoise S Delor, 1380 Gulf Blvd., Sand Key Club #908, Clearwater, FL (US) 33767

( * ) Notice: Subject to any disclaimer, the term of this patent is extended or adjusted under 35 U.S.C. 154(b) by 0 days.

(21) Appl. No.: 11/778,739

(22) Filed: Jul. 17, 2007

Related U.S. Application Data

(60) Provisional application No. 60/820,605, filed on Jul. 27, 2006.

(51) Int. Cl.
*H01H 35/14* (2006.01)

(52) U.S. Cl. ..... 200/61.45 R; 200/61.51; 200/61.52; 200/61.53

(58) Field of Classification Search ..... 200/61.45 R–61.53; 73/514.01, 514.16, 514.29, 514.35
See application file for complete search history.

(56) References Cited

U.S. PATENT DOCUMENTS 2,758,195 A * 8/1956 Ludwig ..... 362/227
3,101,569 A * 8/1963 Giardina ..... 446/230
4,503,299 A * 3/1985 Henrard et al. ..... 200/61.52
4,569,239 A * 2/1986 Shirley et al. ..... 74/89.34
4,590,568 A * 5/1986 Barske et al. ..... 701/93
4,697,174 A * 9/1987 Viator, Sr. ..... 340/689
4,737,759 A * 4/1988 Stropkay et al. ..... 340/440
5,136,126 A * 8/1992 Blair ..... 200/61.52
5,442,332 A * 8/1995 Hughes ..... 340/467
5,602,429 A * 2/1997 Scgiebelhuth ..... 307/121
5,627,316 A * 5/1997 De Winter et al. ..... 73/514.32
6,111,609 A * 8/2000 Stevens ..... 348/372
6,414,593 B1 * 7/2002 Conner et al. ..... 340/475

* cited by examiner

*Primary Examiner*—Michael A Friedhofer
(74) *Attorney, Agent, or Firm*—H. John Rizvi; Glenn E. Gold; Gold & Rizvi, P.A.

(57) ABSTRACT

An inertial mass detection device. An illustrative embodiment of the device includes a generally elongated ball track, at least one pair of spaced-apart switch contacts provided on the ball track, a battery connected to a first one of the at least one pair of spaced-apart switch contacts, at least one inertia indicating device connected to the battery and to a second one of the at least one pair of spaced-apart switch contacts and an electrically-conductive contact ball rollably provided on the ball track.

18 Claims, 3 Drawing Sheets

INERTIAL MASS DETECTION DEVICE

CROSS-REFERENCE TO RELATED APPLICATIONS

This application claims the benefit of and incorporates by reference in its entirety U.S. Provisional application No. 60/820,605, filed Jul. 27, 2006 and entitled "Automobile Inertial Mass Detection Device to Decrease Fuel Consumption".

BACKGROUND OF THE INVENTION

1. Field of the Invention

The present invention generally relates to motorized vehicles, and more particularly, to an inertial mass detection device, which renders in a visible and/or audible manner the inertial mass of a moving vehicle for the purpose of reducing fuel consumption.

2. Description of the Prior Art

Efforts to conserve fuel derived from petrol usually used in motorized vehicles have become increasingly intense in recent years due to the rising cost of gasoline. Internal combustion engines are the most widely-used type of engine for automobiles and are also relatively inefficient. Therefore, recent fuel conservation efforts have included designing engines which are capable of consuming a variety of fuels including ethanol or gasoline/ethanol mixtures (also known as "gasohol").

Due in large part to limitations of the internal combustion engine, use of alternative fuels for automobile propulsion has not been widely adopted. Because of the highly accurate tolerances which are required in piston engines, use of more than one type of fuel without a general resetting of the engine is frequently not feasible.

The excessive weight of internal combustion engines has led to an emphasis on designing alternative types of propulsion devices and piston engines having fewer than eight cylinders. Some alternative types of propulsion devices include electric motors and hybrid electric vehicles (HEVs). Hybrid electric vehicles typically include electric traction motors, high-voltage electric energy storage systems and modified transmissions. While it is necessary to use fuel energy to move and maintain an internal combustion vehicle in motion, once the vehicle is in motion it accumulates free inertial mass which can be harnessed by the driver's efficient driving responding to the device's indication.

In current use, there are millions of vehicles which are powered by internal combustion engines or a hybrid combination of electric and internal combustion engines. These vehicles are commonly acted upon by inertial forces during driving. Enabling operators of these vehicles to visualize the inertial forces which are not due to gravity and are acting upon the vehicle at any particular time, as determined by the second law of motion, can enable the vehicle operators to conserve fuel and avoid aggressive driving such as unnecessarily rapid acceleration followed by braking. By visualizing and learning to recognize and reduce aggressive driving, studies have found that gas mileage may be reduced by approximately 33 percent at highway speeds.

A cruise control system automatically controls the speed of a vehicle. In typical operation of a cruise control, the driver of the vehicle brings the vehicle up to a desired speed using the vehicle's accelerator and typically depresses a button to set the cruise control to the selected speed. The cruise control system then controls the throttle of the vehicle to maintain the selected speed of the vehicle.

A cruise control system of a vehicle may cause higher fuel consumption than is necessary because it tends to over throttle on upward slopes, wasting the energy storage capabilities which are available from the inertia of the vehicle.

Therefore, what is needed is an inertial mass detection device which renders in a visible or audible manner the inertial mass of a moving vehicle at all time for the purpose of reducing fuel consumption. In some applications, the inertial mass detection device is connected to a cruise control system of a vehicle and automatically turns-off the original setup speed of the cruise control when necessary to conserve fuel, allowing the driver to control the vehicle's speed again.

SUMMARY OF THE INVENTION

The present invention is generally directed to an inertial mass detection device which constantly renders in a visible or audible manner any change occurring in the inertial mass of a moving vehicle for the purpose of reducing fuel consumption.

In one aspect of the invention, the inertial mass detection device includes:

a generally elongated, horizontally fine-tuned ball track;

at least one pair of spaced-apart switch contacts provided on the ball track;

a battery connected to a first one of the at least one pair of spaced-apart switch contacts; at least one inertia indicating device connected to the battery and to a second one of the at least one pair of spaced-apart switch contacts; and an electrically-conductive contact ball rollably provided on the ball track.

In another aspect of the invention, the at least one inertia indicating device is provided on a casing.

In still another aspect of the invention, the ball track has a generally V-shaped cross-section.

In yet another aspect of the invention, the at least one inertia indicating device comprises an energy-consumption indicator light.

In a further aspect of the invention, the at least one pair of spaced-apart switch contacts comprises a first pair and a second pair of spaced-apart switch contacts and the at least one inertia indicating device further comprises an energy-conservation indicator light connected to a second one of the second pair of spaced-apart switch contacts.

In a still further aspect of the invention, the energy-consumption indicator light is red and the energy-conservation indicator light is green.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawing, in which.

DETAILED DESCRIPTION OF THE PREFERRED EMBODIMENTS

Shown throughout the drawings, the present invention is generally directed towards an inertial mass detection device which renders in a visible and/or audible manner the inertial mass of a moving vehicle for the purpose of reducing fuel consumption. In some embodiments, a cruise control modifying device is connected to the inertial mass detection device. A cruise control of a vehicle is connected to the cruise control modifying device. The cruise control modifying device is operable to disconnect or adjust the vehicle's cruise control setting to operate the vehicle at a variable speed in the event that the inertial mass detection device signals that the vehicle's inertia is consistent with inefficient fuel consumption.

Figure 1:
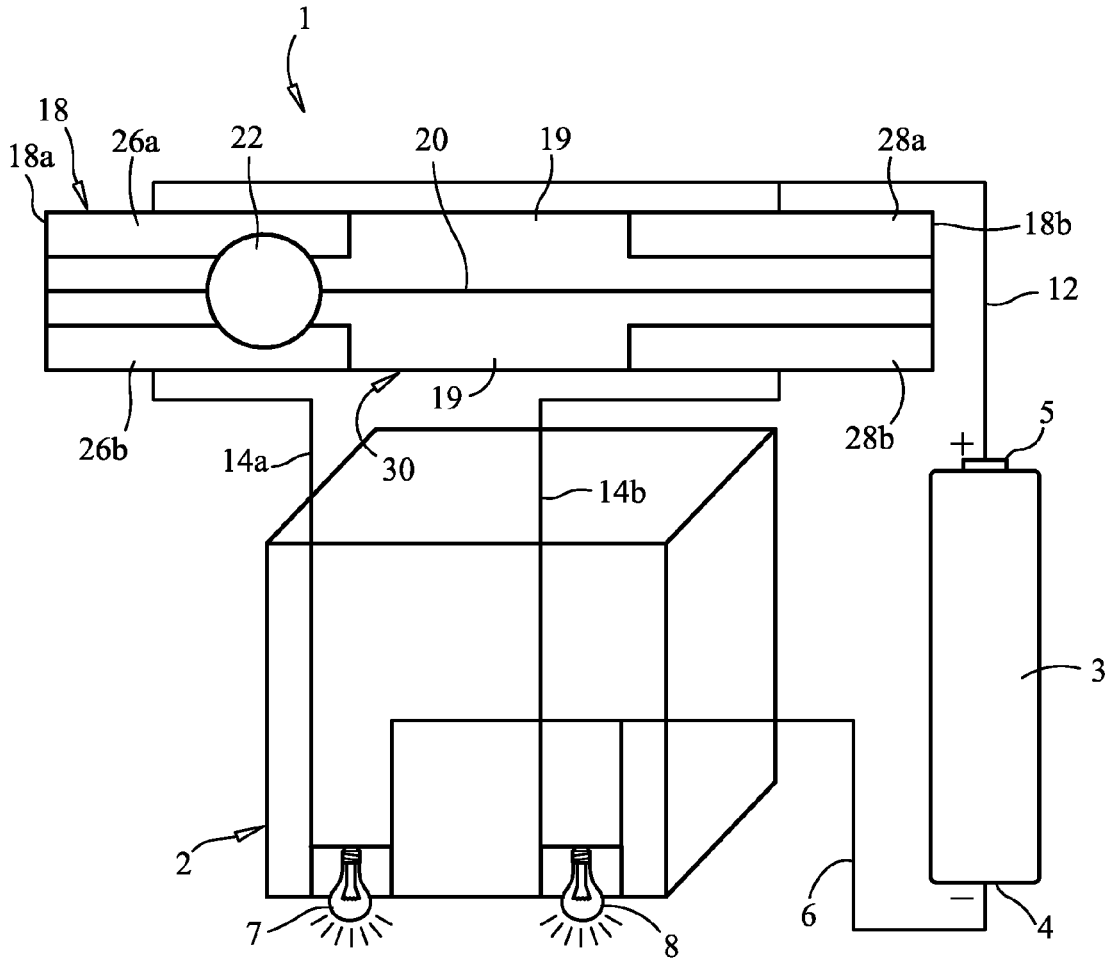
FIG. 1 is a schematic view of an illustrative embodiment of the inertial mass detection device.
Figure 2:
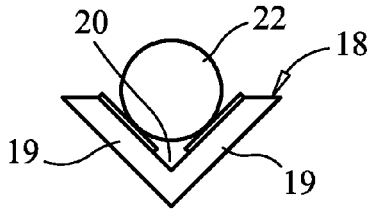
FIG. 2 is a cross-sectional view of a ball track element of an illustrative embodiment of the inertial mass detection device.

Referring initially to FIGS. 1 and 2 of the drawings, an illustrative embodiment of the inertial mass detection device, hereinafter device, is generally indicated by reference numeral 1. The device 1 includes a casing 2 which typically contains the functional components of the device 1. An inertia indicating device is provided on the casing 2. In some embodiments, the inertia indicating device includes an energy-consumption (usually acceleration) indicator light 7 and an energy-conservation (usually deceleration) indicator light 8. The energy-consumption indicator light 7 and the energy-conservation indicator light 8 are typically different colors. In some embodiments, the energy-conservation indicator light 7 is red and the energy-conservation indicator light 8 is green, although alternative colors or distinguishing visual characteristics may be used. A battery 3, having a negative pole 4 and a positive pole 5, is typically provided in the casing 2. In some other embodiment, the vehicle's battery is used. The battery 3 is electrically connected to the energy-consumption indicator light 7 and the energy-conservation indicator light 8 via a light contact 6 which is disposed in electrical contact with a first one of the negative pole 4 and the positive pole 5. A switch contact 12 is disposed in electrical contact with a second one of the negative pole 4 and the positive pole 5.

The device 1 further includes a generally elongated ball track 18 which is typically provided in the casing 2. The ball track 18 is fine-tuned to a horizontal position in the casing 2. The ball track 18 has a first track end 18*a* and a second track end 18*b*. As illustrated in FIG. 2, in some embodiments the ball track 18 has a generally V-shaped cross-section and includes a pair of elongated track segments 19 which are disposed at an angle with respect to each other. A track trench 20 extends along the ball track 18, between the track segments 19. A first pair of generally elongated, spaced-apart electrically-conductive switch placed in an opposite positioned contacts 26*a*, 26*b* is provided on the track segments 19, respectively, generally at or adjacent to the first track end 18*a* of the ball track 18. A second pair of generally elongated, spaced-apart electrically-conductive switch placed in an opposite positioned contacts 28*a*, 28*b* is provided on the track segments 19, respectively, generally at or adjacent to the second track end 18*b* of the ball track 18. As illustrated in FIG. 1, a gap 30 separates the second pair of switch contacts 28*a*, 28*b* from the first pair of switch contacts 26*a*, 26*b*. A contact ball 22, which is an electrically-conductive material, is provided on the ball track 18. The contact ball 22 is capable of freely moving on the track segments 19 between the first track end 18*a* and the second track end 18*b*. Accordingly, as it traverses the first pair of switch contacts 26*a*, 26*b*, the contact ball 22 establishes electrical contact between the first pair of switch contacts 26*a*, 26*b*. In like manner, as it traverses the second pair of switch contacts 28*a*, 28*b*, the contact ball 22 establishes electrical contact between the second pair of switch contacts 28*a*, 28*b*.

As further illustrated in FIG. 1, the switch contact 12 is disposed in electrical contact with the switch contact 26*a* of the first pair of switch contacts 26*a*, 26*b* and the switch contact 28*a* of the second pair of switch contacts 28*a*, 28*b*. An energy-consumption light contact 14*a* establishes electrical communication between the switch contact 26*b* of the first pair of switch contacts 26*a*, 26*b* and the energy-consumption indicator light 7. An energy-conservation light contact 14*b* establishes electrical communication between the switch contact 28*b* of the second pair of switch contacts 28*a*, 28*b* and the energy-conservation indicator light 8. Accordingly, when the contact ball 22 contacts the first pair of switch contacts 26*a* and 26*b*, an electrical circuit is completed between the battery 3 and the energy-consumption indicator light 7, thereby illuminating the energy-consumption indicator light 7. When the contact ball 22 contacts the second pair of switch contacts 28*a* and 28*b*, an electrical circuit is completed between the battery 3 and the energy-conservation indicator light 8, thereby illuminating the energy-conservation indicator light 8.

Figure 3:
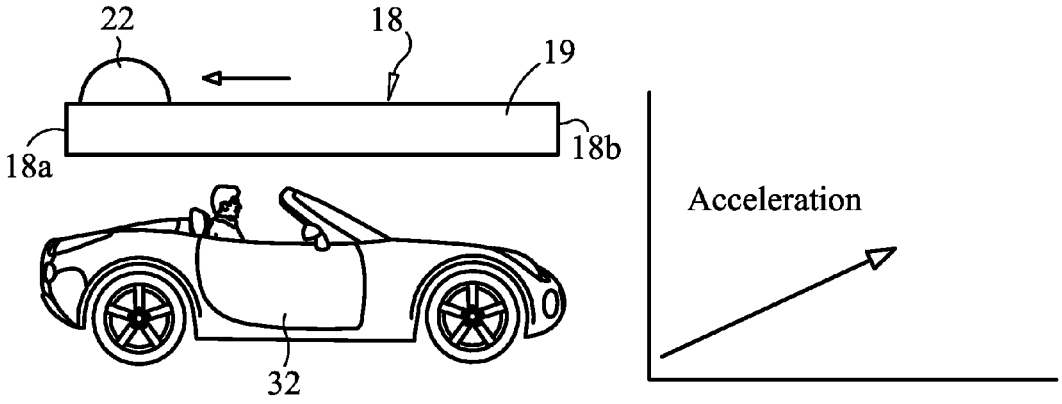
FIG. 3 is a side view of the ball track element of an illustrative embodiment of the inertial mass detection device, more particularly illustrating rearward movement of a metallic mass on the ball track during an increase of the inertial mass of a vehicle (shown in side view)
Figure 4:
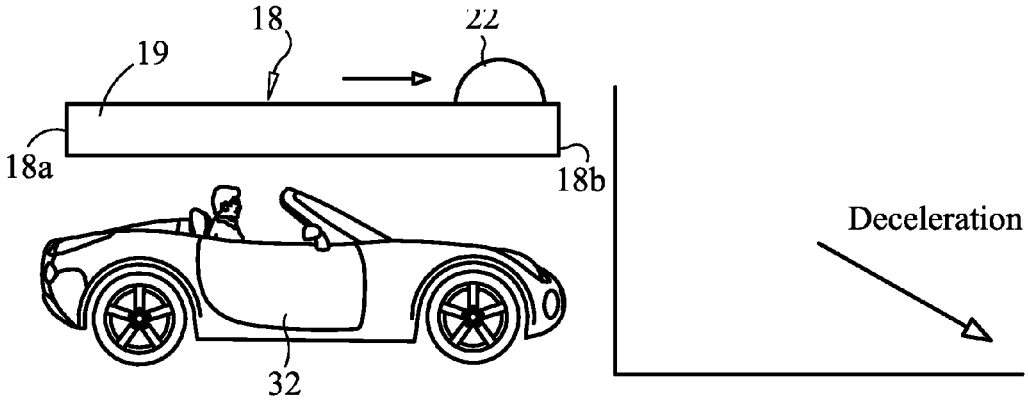
FIG. 4 is a side view of the ball track element of an illustrative embodiment of the inertial mass detection device, more particularly illustrating forward movement of a metallic mass on the ball track during decrease of the inertial mass of a vehicle (shown in side view)

Referring next to FIGS. 3 and 4 of the drawings, in typical application the device 1 is mounted in a vehicle 32 and fine-tuned in a horizontal position. The casing 2 is mounted typically on the dashboard (not illustrated) or in any other suitable location in the vehicle 32. During the accumulation of inertial mass of the vehicle 32, such as but not limited to upon acceleration of the vehicle 32, inertia which acts upon the contact ball 22 pulls the contact ball 22 on the ball track 18 toward the first track end 18*a*, such that the contact ball 22 establishes electrical contact between the first pair of switch contacts 26*a* and 26*b*, thereby closing the circuit between the battery 3 and the indicator light 7 and illuminating the indicator light 7. This visual cue usually indicates accumulation of inertial mass of the vehicle 32, allowing the driver (not illustrated) of the vehicle 32 to reduce acceleration of the vehicle 32 or decelerate the vehicle 32 to a degree which reduces excess consumption of fuel through the fuel flow regulation feature (accelerator), as the vehicle 32 continues forward motion due to the forward inertial forces acting upon the vehicle 32. Upon the decrease or dissipation of the accumulated inertial mass of the vehicle 32, such as but not limited to that which occurs usually during deceleration of the vehicle 32, inertia causes the contact ball 22 to roll along the ball track 18 toward the second track end 18*b*. Consequently, the contact ball 22 establishes electrical contact between the second pair of switch contacts 28*a* and 28*b*, thereby closing the circuit between the battery 3 and the indicator light 8 and illuminating the indicator light 8. This visual cue indicates to the driver of the vehicle 32 that the vehicle 32 is operating in a fuel conservation mode dissipation of the inertial mass of the vehicle 32, indicating to the driver that the vehicle 32 is operating in a fuel-conserving mode, which is continued until the operator of the vehicle 32 deems it necessary to again increase or accumulate the inertial mass of the vehicle 32 by acceleration of the vehicle 32. Therefore, the driver is capable of operating the vehicle 32 at the optimal speed according to the prevailing driving conditions, vehicle weight, speed regulation, traffic and other factors in order to attain the greatest distance traveled per gallon of fuel consumed (MPG), decrease carbon dioxide emissions to limit atmosphere pollution and global warming, save the vehicle components' premature wear and tear due to rough driving and provide enhanced comfort and security to the driver and other occupants of the vehicle.

Figure 5:
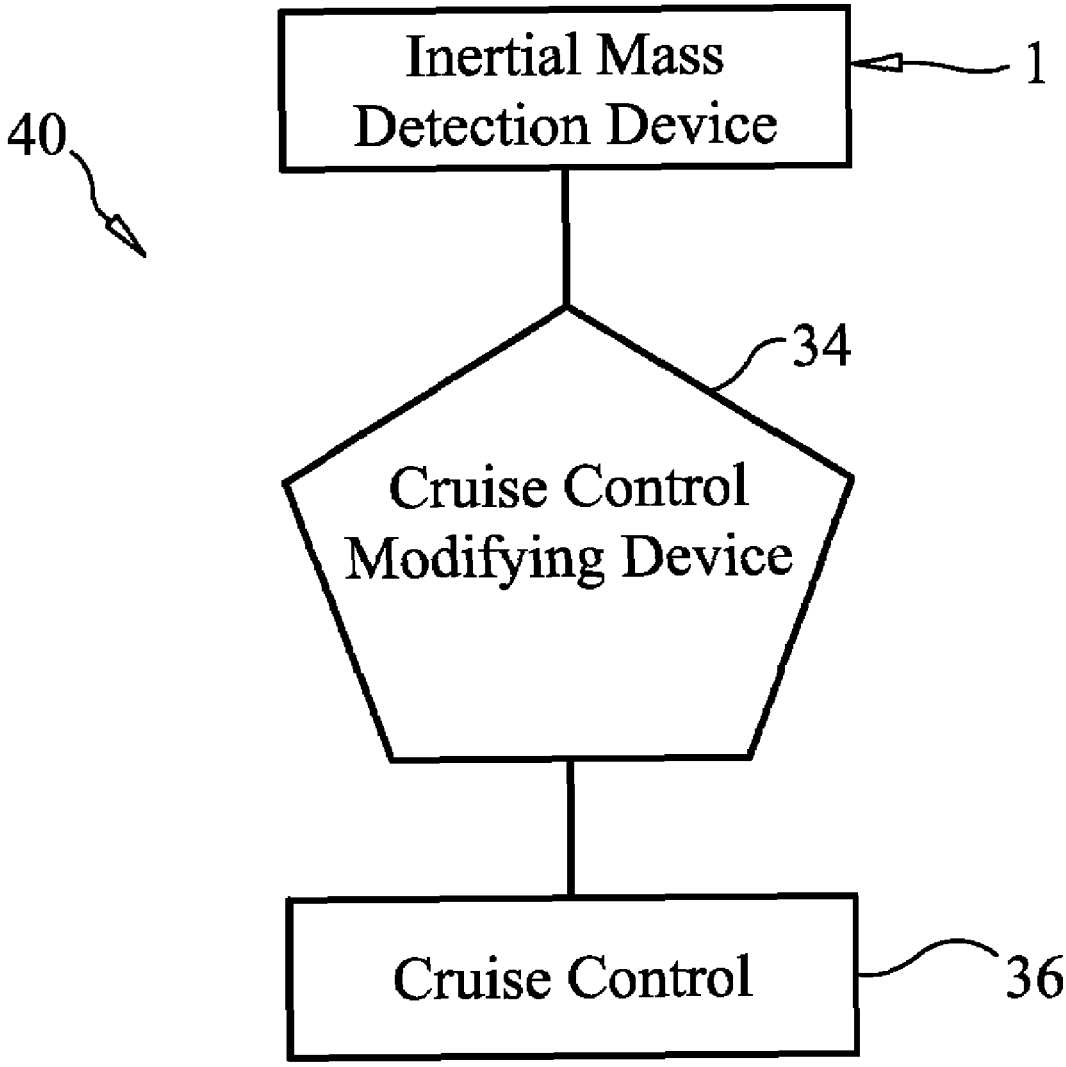
FIG. 5 is a block diagram which illustrates an illustrative embodiment of the inertial mass detection device connected to a cruise control modifying device and a vehicle cruise control in one illustrative application of the inertial mass detection device.

Referring next to FIG. 5 of the drawings, in one exemplary application, the device 1 is part of a system 40 in which a cruise control modifying device 34 is connected to at least the first pair of switch contacts 26*a* and 26*b* (FIG. 1) of the device 1. A cruise control system 36 of a vehicle is, in turn, connected to the cruise control modifying device 34. The cruise control system 36 may be conventional and is programmed to operate the vehicle at a setup speed which is selected by the driver of the vehicle. The cruise control modifying device 34 is operable to disconnect or reduce the setup speed of the vehicle cruise control system 36 in the event that the device 1 signals that the vehicle's inertia is consistent with a lack of accumulated inertial mass (red light) such as during unnecessary acceleration, for example, corresponding to increased fuel consumption. This, in turn, facilitates forward motion of the vehicle as a result of the forward inertial forces of the vehicle, conserving fuel. The cruise control modifying device 34 may be programmed to disconnect or re-adjust the setup speed of the vehicle cruise control system 36 back to the original setup speed when the device 1 indicates that the vehicle's inertia is consistent with decreasing inertial mass as in the case of deceleration. It will be appreciated that when the inertial mass detection device's red energy-consumption mode indicator light 7 is illuminated, the driver is informed that the vehicle moves on energy-consumption mode. Energy-consumption mode usually occurs when the driver increases the fuel flow to the carburetor with the accelerator to increase the vehicle's speed but it can occur otherwise as well. Alternatively, when the inertial mass detection device's green energy-conservation mode indicator light 8 is illuminated, the driver is informed that the vehicle moves on energy-conservation mode in a fuel efficient manner. Energy conservation mode usually occurs when the vehicle is moved using only the vehicle's inertial force accumulated.

It will be appreciated by those skilled in the art that the inertia indicating device can be any type of device which is capable of indicating the energy-consumption mode and energy-conservation mode of the vehicle and is not limited to the energy-consumption mode indicator light 7 and the energy-conservation mode indicator light 8 which was heretofore described with respect to FIG. 1. For example, in some embodiments the inertial mass indicating device includes a needle (not illustrated) which points to a first area as the vehicle is moving in the energy-consumption mode and to a second area as the vehicle is moving in the energy-conservation mode. In other embodiments, the inertia indicating device includes an auditory alarm (not illustrated) which emits a first sound in the event the vehicle is moving in the energy-consumption mode such as acceleration and a second sound in the event the vehicle is moving in the energy-conservation mode such as deceleration. These inertia indicating devices can be used individually or in combination with each other to indicate the inertia of the vehicle.

While the preferred embodiments of the invention have been described above, it will be recognized and understood that various modifications can be made in the invention and the appended claims are intended to cover all such modifications which may fall within the spirit and scope of the invention.

What is claimed is:

1. An inertial mass detection device, comprising:

a generally elongated ball track;

at least one pair of spaced-apart switch contacts provided on said ball track;

a battery connected to a first one of said at least one pair of spaced-apart switch contacts;

at least one inertia indicating device connected to said battery and to a second one of said at least one pair of spaced-apart switch contacts;

an electrically-conductive contact ball rollably provided on said ball track; and wherein said at least one inertia indicating device comprises an energy-consumption indicator light.

2. The device of claim 1 further comprising a casing and wherein said at least one inertia indicating device is provided on said casing.

3. The device of claim 1 wherein said ball track has a generally V-shaped cross-section.

4. The device of claim 1 wherein said at least one pair of spaced-apart switch contacts comprises a first pair and a second pair of spaced-apart switch contacts and said at least one inertia indicating device further comprises an energy-conservation indicator light connected to a second one of said second pair of spaced-apart switch contacts.

5. The device of claim 4 wherein said energy-consumption indicator light is red.

6. The device of claim 5 wherein said energy-conservation indicator light is green.

7. An inertial mass detection device, comprising:

a generally elongated ball track;

a first pair of spaced-apart switch contacts provided on said ball track;

a second pair of spaced-apart switch contacts provided on said ball track in spaced-apart relationship with respect to said first pair of spaced-apart switch contacts;

a battery connected to a first one of said first pair of spaced-apart switch contacts and a first one of said second pair of spaced-apart switch contacts;

at least one inertia indicating device connected to said battery and to at least one of a second one of said first pair of spaced-apart switch contacts and a second one of said second pair of spaced-apart switch contacts;

an electrically-conductive contact ball rollably provided on said ball track; and wherein said at least one inertia indicating device comprises an energy-consumption indicator light connected to said second one of said first pair of spaced-apart switch contacts.

8. The device of claim 7 further comprising a casing and wherein said at least one inertia indicating device is provided on said casing and said ball track, said contact ball and said battery are provided in said casing.

9. The device of claim 7 wherein said ball track has a generally V-shaped cross-section.

10. The device of claim 7 wherein said at least one inertia indicating device further comprises an energy-conservation indicator light connected to said second one of said second pair of spaced-apart switch contacts.

11. The device of claim 10 wherein said energy-consumption indicator light is red.

12. The device of claim 11 wherein said energy-conservation indicator light is green.

13. The device of claim 7 wherein said ball track comprises a pair of generally elongated track segments disposed in angular relationship with respect to each other.

14. The device of claim 13 further comprising a track trench between said track segments.

15. The device of claim 7 wherein said first pair of spaced-apart switch contacts and said second pair of spaced-apart switch contacts have a generally elongated, placed in an opposite positioned configuration.

16. A system, comprising:

an inertial mass detection device comprising:

a generally elongated ball track;

at least one pair of spaced-apart switch contacts provided on said ball track;

a battery connected to a first switch contact of said at least one pair of spaced-apart switch contacts;

at least one of an energy-consumption indicator light and an energy-conservation indicator light connected to a second switch contact of said at least one pair of spaced-apart switch contacts; and an electrically-conductive contact ball rollably provided on said ball track;

a cruise control modifying device connected to said at least one pair of spaced-apart switch contacts of said inertial mass detection device; and a vehicle cruise control connected to said cruise control modifying device.

17. The system of claim 16 wherein said battery comprises the vehicle's battery.

18. The system of claim 16 wherein said ball track comprises a pair of generally elongated track segments disposed in angular relationship with respect to each other.

* * * * *